US007565982B2

(12) United States Patent
Kurotsu et al.

(10) Patent No.: US 7,565,982 B2
(45) Date of Patent: Jul. 28, 2009

(54) CRANE AND BOOM HOISTING DEVICE THEREOF

(75) Inventors: Hitoshi Kurotsu, Akashi (JP); Osamu Todo, Akashi (JP); Kazuyuki Miyazaki, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 0 days.

(21) Appl. No.: 11/739,438

(22) Filed: Apr. 24, 2007

(65) Prior Publication Data

US 2007/0256999 A1 Nov. 8, 2007

(30) Foreign Application Priority Data

May 8, 2006 (JP) ..... 2006-129413

(51) Int. Cl.
*B66C 23/82* (2006.01)

(52) U.S. Cl. ..... 212/298; 212/175; 212/239; 212/262

(58) Field of Classification Search ..... 212/239, 212/262, 298, 175–177
See application file for complete search history.

(56) References Cited

U.S. PATENT DOCUMENTS 2,362,220 A * 11/1944 Shoemaker ..... 212/172
2,774,484 A * 12/1956 White ..... 212/178
2,778,514 A * 1/1957 McLean ..... 414/735
2,869,735 A * 1/1959 Page ..... 212/262
3,426,917 A * 2/1969 Siegel ..... 212/264
4,166,542 A * 9/1979 Bryan, Jr. ..... 212/231
4,421,241 A * 12/1983 Wittman et al. ..... 212/298
4,582,205 A * 4/1986 Berger et al. ..... 212/175
5,005,714 A * 4/1991 Kröll et al. ..... 212/196

FOREIGN PATENT DOCUMENTS

| | | |
|---|---|---|
| EP | 1 333 004 A2 | 8/2003 |
| EP | 1 524 236 A1 | 4/2005 |
| JP | 59-105286 | 7/1984 |
| JP | 60-23289 | 2/1985 |
| JP | 62-34587 | 2/1987 |
| JP | 2542385 | 4/1997 |
| JP | 11-263585 | 9/1999 |

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

A boom hoisting device comprising a mast having a pivotable front end portion connected to a front end portion of a boom through a guy line, a mast-side spreader provided at the front end portion of the mast, a frame-side spreader removably mounted to an upper rotating body and with a hoisting rope being stretched between and spread on both mast-side spreader and frame-side spreader, and a hoisting winch adapted to unwind and wind the hoisting rope to raise and lower the mast and the boom, the hoisting winch being mounted to the mast so that the mast and the hoisting winch are together removed from the upper rotating body by separation of a base end portion of the mast from the upper rotating body.

1 Claim, 5 Drawing Sheets

CRANE AND BOOM HOISTING DEVICE THEREOF

BACKGROUND OF THE INVENTION

1. Field of the Invention

The present invention relates to a crane and a boom hoisting device of the crane, permitting easy removal of a mast or a gantry for raising and lowering a boom attached to a body frame.

2. Description of the Related Art

The related art will be described below with reference to FIG. 4 showing a crawler crane as an example.

This crane has a body frame comprising a lower travel body 1 of a crawler type and an upper rotating body 2 mounted on the lower travel body 1 so as to be rotatable about a vertical axis.

The upper rotating body 2 is basically composed of a boom 4 mounted on a rotating frame 3 as a base, three winches 5, 6, 7 as main hoist, auxiliary hoist and boom hoisting winches, respectively, and a mast 8 for raising and lowering the boom 4.

A base end portion 8*a* of the mast 8 is attached to a front side portion 3*a* of the rotating frame 3 so as to be pivotable about a horizontal axis and attached detachably to the front side portion 3*a* of the rotating frame 3. In order to avoid mutual interference of wire ropes delivered from the winches 5 to 7, these winches are mounted at intervals on the rotating frame 3 in the order of main hoist winch, auxiliary hoist winch and boom hoisting winch from the front side.

As shown in FIG. 4, a hoisting wire rope 12 of the boom hoisting winch 7 is stretched through an upper spreader 9 provided at an upper end portion of the mast 8 and is spread like a rattan blind on both a sheave of the upper spreader 9 and a sheave of a lower spreader 10 mounted on a rear portion of the rotating frame 3. Thus, when the boom hoisting winch 7 is operated to unwind or wind the hoisting rope 12, thereby changing the distance between the upper spreader 9 and the lower spreader 10, the mast 8 rises or lowers, so that the boom 4, which is connected to the mast 8 through a guy line 11, also rises or lowers.

As another upper rotating body, as shown in FIG. 5, one provided as a substitute for the mast 8 with a gantry 30 having a gantry compressing member 31 and a gantry pulling member 32 is known (see, for example, Japanese Registered Utility Model No. 2542385).

In the gantry 30 shown in FIG. 5, a base end portion 31*a* of the gantry compressing member 31 is connected to a front side portion of the rotating frame 3 and a base end portion 32*a* of the gantry pulling member 32 is connected to the rear side portion of the rotating frame 3 each pivotably in the hoisting direction. At a gantry top 33 to which front end portions 31*b* and 32*b* of both members 31 and 32 are connected in a relatively pivotable manner there is provided a gantry-side spreader 20. A guy line 22 is connected at one end thereof to a front end of the boom 4 and a guy line-side spreader 21 is connected to an opposite end of the guy line 22. A wire rope 47 drawn out from the boom raising/lowering winch 7 is spread on both spreaders 20 and 21. Therefore, when the boom hoisting winch 7 is operated to unwind or wind the hoisting rope 47, thereby changing the distance between both spreaders 20 and 21, the boom 4 rises or lowers. In FIG. 5, the numeral 23 denotes a mounting portion for mounting the boom 4, numeral 5 denotes a main hoist winch, and numeral 6 denotes an auxiliary hoist winch. In FIG. 5, the same portions as in FIG. 4 are identified by the same reference numerals as in FIG. 4.

Further, as described later, there is known a crane of the construction wherein both mast and gantry are used in combination and the mast is raised and lowered by the gantry to raise and lower a boom.

When moving to a work site, this crane is dismantled for transport by a trailer or the like. This dismantling is performed so as to satisfy the transport weight allowed for the trailer or the like.

For reducing the transport weight in the above upper rotating body, the boom which is heavy and a counterweight are removed of course. Besides, in a large- or ultra-large-sized crane having a very heavy upper rotating body, there sometimes is a case where it is necessary to remove a mast or a gantry.

However, since a hoisting wire rope connected to the boom hoisting winch is spread on the mast or the gantry, there has been the problem that the removal and mounting of the mast and the gantry are troublesome. More particularly, for removing the mast or the gantry it is necessary to pull out the hoisting wire rope and thus a very troublesome work requiring a long time is needed. Conversely, when mounting the mast or the gantry, it is necessary to pass the hoisting wire rope therethrough and thus here again a very troublesome work requiring a long time is needed.

SUMMARY OF THE INVENTION

It is an object of the present invention to provide a crane and a boom hoisting device of the crane, permitting easy removal of a mast or a gantry from a body frame without pulling out a hoisting wire rope connected to a boom hoisting winch.

The crane and boom hoisting device of the crane according to the present invention have the following basic configurations.

A boom hoisting device of a crane according to the present invention is mounted on a body frame of the crane having a boom capable of rising and lowering and causes the boom to rise and lower, the boom hoisting device comprising a mast, the mast having a base end portion connected to the body frame removably and pivotably about an approximately horizontal axis and further having a pivotable front end portion connected to a front end portion of the boom through a guy line, a mast-side spreader provided at the front end portion of the mast, a frame-side spreader removably mounted on the body frame side, with a hoisting rope being stretched between and spread on both frame-side spreader and the mast-side spreader, and a raising/lowering winch adapted to unwind and wind the hoisting rope to raise and lower the mast and the boom, the hoisting winch being installed to the mast so that the mast and the hoisting winch are together removed from the body frame by separation of the base end portion of the mast from the body frame.

The installation of the frame-side spreader is not limited to the installation to the body frame, but the frame-side spreader may be installed to a member (e.g., gantry) fixed to the body frame side. The spreader indicates a spreader having a sheave and a support member which journals the sheave pivotably and capable of being removed from the mast, the gantry or the body frame to which it is to be mounted.

A crane according to the present invention has the above boom hoisting device and comprises a body frame, a boom mounted on the frame body so that it can rise and lower, and a guy line providing connection between a front end portion of the boom and the front end portion of the mast in the boom hoisting device, the base end portion of the mast and the frame-side spreader in the boom hoisting device being mounted to the body frame removably.

In this case, since a hoisting winch for raising and lowering the mast and the boom is installed to the mast, the mast and the hoisting winch are together removed from the body frame easily by separating the base end portion of the mast from the body frame. If the frame-side spreader is removed from the body frame side at this time or beforehand, it is not necessary to pull out the hoisting wire rope connected to the boom hoisting winch from both spreaders.

Another boom hoisting device of a crane according to the present invention is mounted on a body frame of the crane having a boom capable of rising and lowering and causes the boom to rise and lower, the boom hoisting device comprising a gantry connected to the body frame removably, a gantry-side spreader provided in the gantry, a guy line-side spreader provided at an opposite end of a guy line connected at one end to the boom or at a front end portion of a mast to which the opposite end of the guy line is connected, with a hoisting rope being stretched between and spread on the guy line-side spreader and the gantry-side spreader, and a hoisting winch adapted to unwind and wind the hoisting rope, thereby raising and lowering the boom, the hoisting winch being installed to the gantry so that the gantry and the hoisting winch are together removed from the body frame by separation of the gantry from the body frame.

A crane according to the present invention has the this boom hoisting device and comprises a body frame, a boom mounted on the body frame so that it can rise and lower, and a guy line connected at one end thereof to a front end portion of the boom and with the guy line-side spreader in the boom hoisting device being provided at an opposite end of the guy line, the gantry in the boom hoisting device being mounted to the body frame removably.

In this case, since the hoisting winch for raising and lowering the boom is installed to the gantry, the gantry and the hoisting winch are together removed easily from the body frame by separating the gantry from the body frame. If the guy line-side spreader is removed from the opposite end of the guy line or the front end portion of the mast at this time or beforehand, it is not necessary to pull out the hoisting wire rope connected to the boom hoisting winch from both spreaders.

What is called jib is also included in the above boom.

BRIEF DESCRIPTION OF THE DRAWINGS

FIGS. 1A and 1B are right side views of a crane having a boom hoisting device according to a first embodiment of the present invention, of which FIG. 1A shows the state of the crane just before removal of a mast and FIG. 1B shows the state of the crane after removal of the mast. Further.

FIGS. 3A and 3B are related to a hoisting winch shown in FIG. 2, of which FIG. 3A is a plan view showing an installed place of the hoisting winch and FIG. 3B is a right side view showing an installed place of the hoisting winch;

DESCRIPTION OF THE PREFERRED EMBODIMENTS

Preferred embodiments of the present invention will be described concretely hereinunder.

First Embodiment

Figure 4:
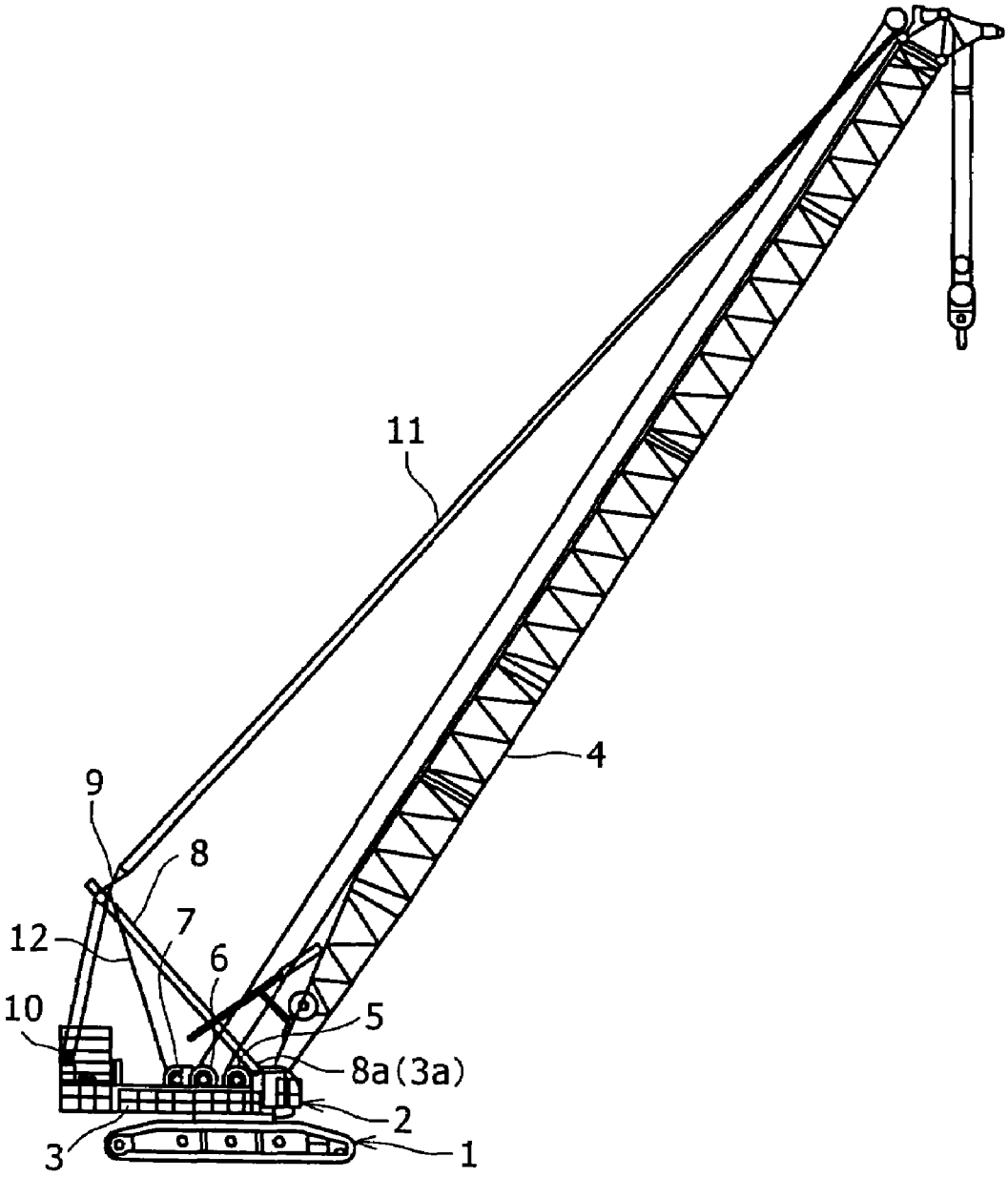
FIG. 4 RELATED ART
FIG. 4 is a right side view showing a crane having a mast as a boom hoisting device according to the related art.

A boom hoisting device according to this first embodiment of the present invention is of the type using a mast and its basic configuration is the same as that of the related art shown in FIG. 4 except that the layout of a winch for raising and lowering a boom and a mast is different, and therefore an explanation of the basic configuration will be omitted.

Figure 1A:
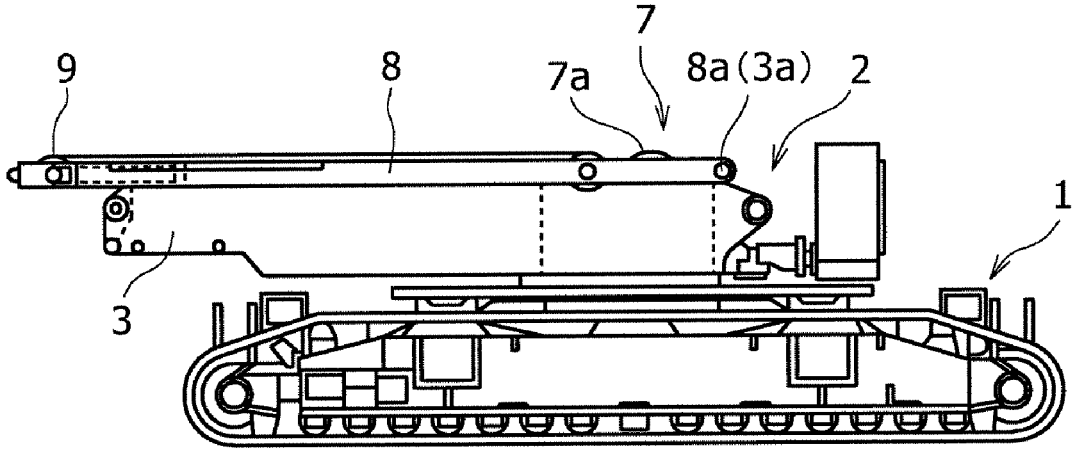
Figure 1B:
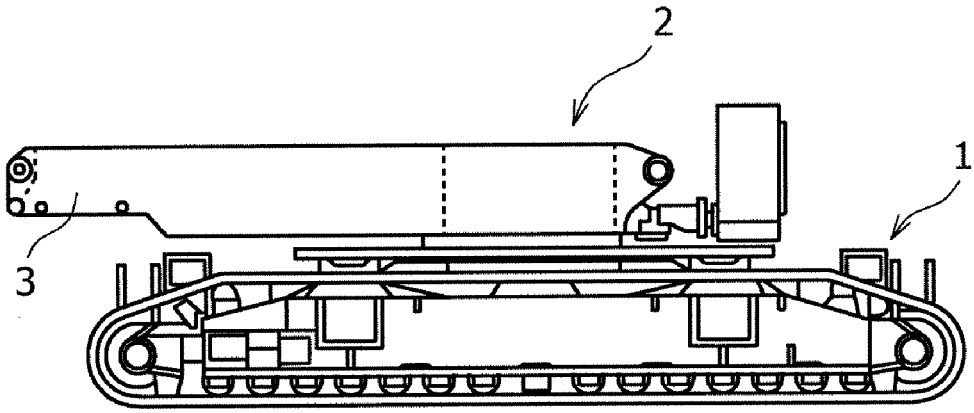
Figure 1C:
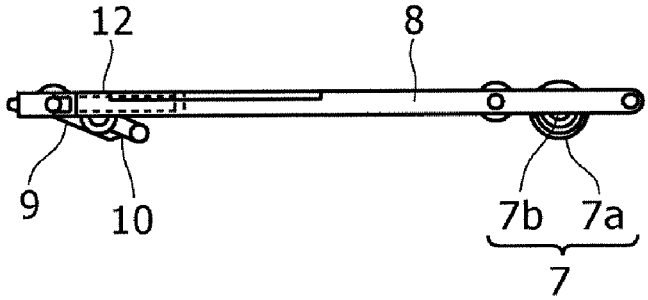
FIG. 1C shows the state of the mast after removal as seen in the same direction as the above right side views.

FIG. 1 is a right side view showing a crane having a boom hoisting device according to the first embodiment, in which FIG. 1A shows the state of the crane just before removal of a mast, FIG. 1B shows the state of the crane after removal of the mast, and FIG. 1C shows the state of the mast after removal. The same portions as in FIG. 4 are identified by the same reference numerals.

In this crane, as noted above, the layout of a hoisting winch 7 for raising and lowering a boom and a mast is different from that in the related art. That is, in the related art the hoisting winch 7 is installed on the rotating frame 3, but in this first embodiment it is installed directly on a mast 8.

The hoisting winch 7 has a drum 7*a* and a shaft 7*b* serving as a rotational center of the drum, both ends of the shaft 7*b* being supported rotatably by brackets (not shown) secured respectively to a pair of left and right frames which constitute the mast 8.

In a preparatory stage just before removal of the mast 8 in the crane of this configuration, as shown in FIG. 1A, a boom and a counterweight are removed from an upper rotating body 2 on a body frame and a guy line connected at both ends to the boom and the mast 8 is also removed, the mast 8 being brought down to the rear side. A frame-side spreader 10 (see FIG. 1C) is in a removed state from an upper rotating body 2. The timing for removal of the frame-side spreader 10 is not specially limited insofar as it is before removal of the mast 8.

After completion of such a preparatory work, a work for removing the mast 8 is performed. This work is done, for example, by lifting the mast 8 with another crane, not the crane related to the present invention, and removing it from the body frame. At this time the mast 8 and the hoisting winch 7 are together removed from the body frame as shown in FIG. 1C because the winch 7 is installed to the mast 8. This mast removing work can be done in a state in which the mast-side spreader 9 is connected to the mast 8 and the both mast-side spreader 9 and frame-side spreader 10 are connected together through a hoisting rope 12. Therefore, it is not necessary to pull out the hoisting rope 12 from both spreaders 9 and 10 and the mast 8 can be removed easily from the body frame. In this mast removing work it is preferable that both spreaders 9 and 10 be drawn close to each other by the hoisting winch 7 to make the frame-side spreader 10 difficult to shake during transport.

As to the form of the body frame when removing the mast 8, there are included an integrally combined state of both lower travel body 1 and upper rotating body 2 and a separated state thereof.

Second Embodiment

A boom hoisting device according to this second embodiment of the present invention uses both mast and gantry. According to a basic configuration thereof, a hoisting winch for raising and lowering both boom and mast is installed to the gantry.

A detailed description will be given below.

Figure 2:
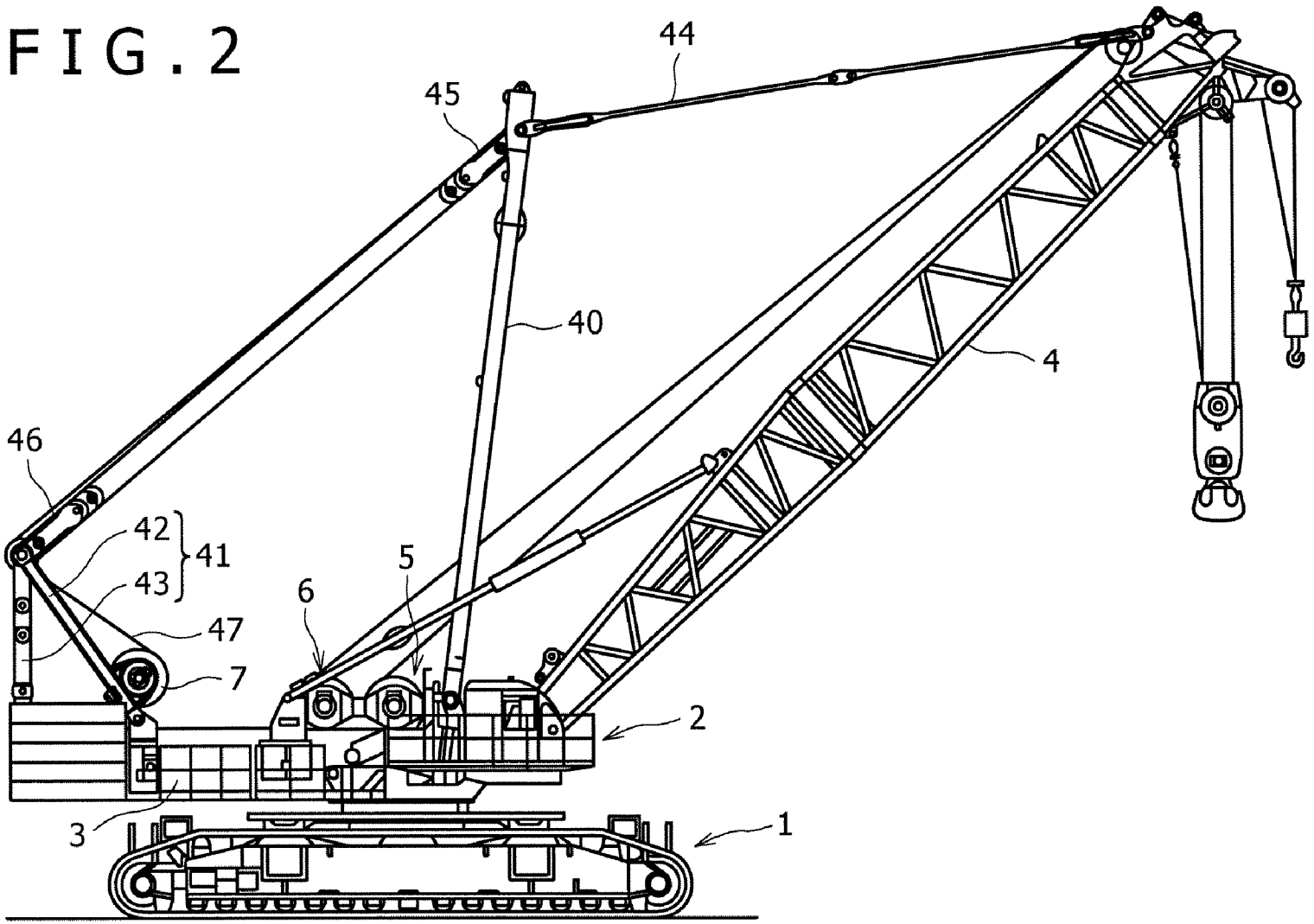
FIG. 2 is a right side view showing a crane having a boom hoisting device according to a second embodiment of the present invention.
Figure 3A:
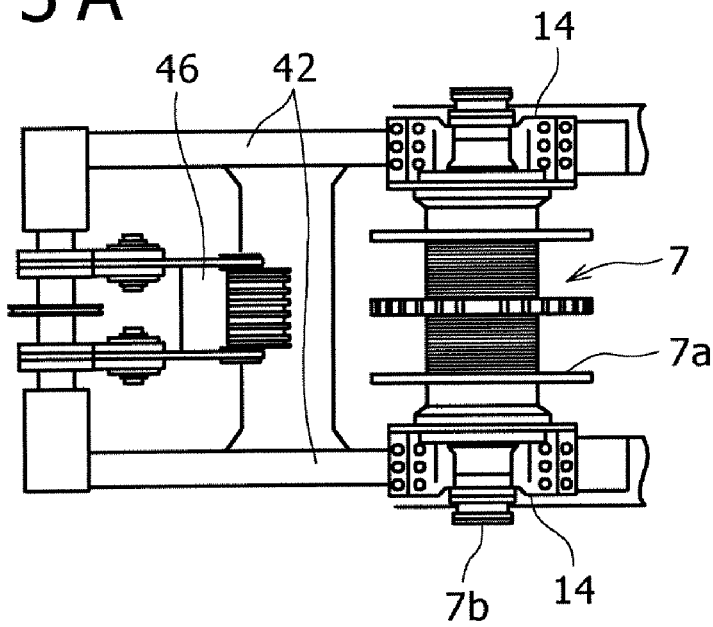
Figure 3B:
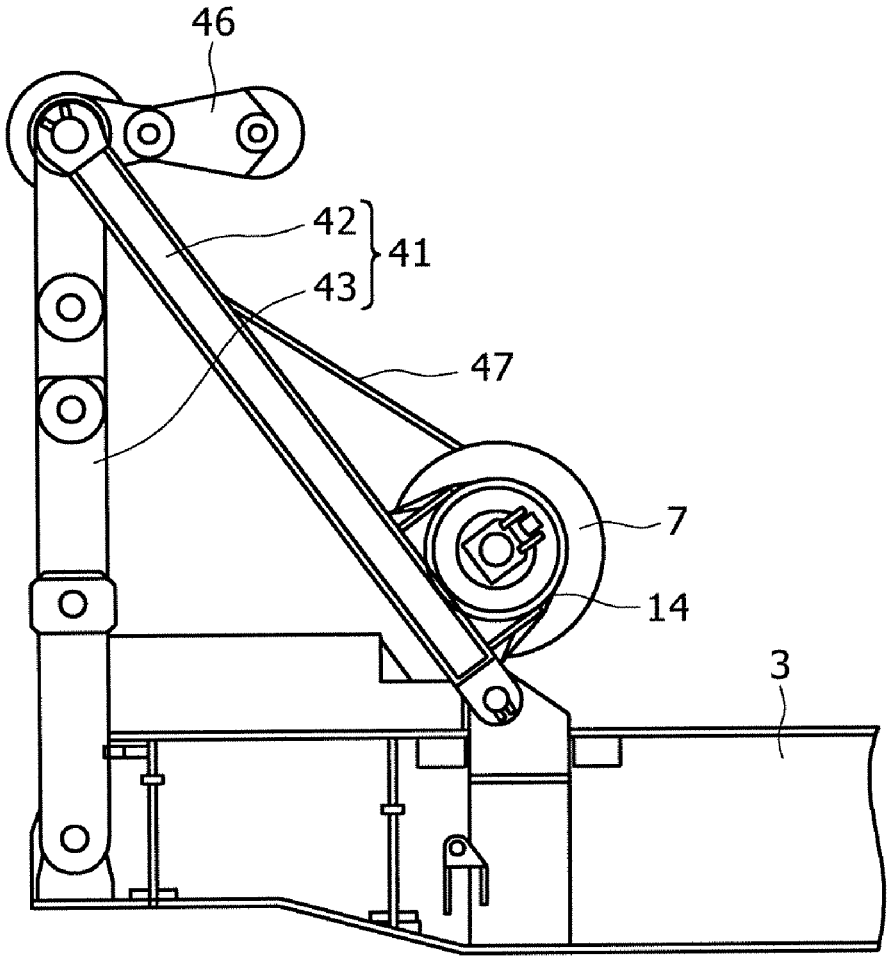

FIG. 2 is a right side view showing a crane having the boom hoisting device of this second embodiment, FIG. 3A is a plan view showing an installed place of a hoisting winch, and FIG. 3B is a right side view showing an installed place of a hoisting winch.

In this crane, a mast 40 is disposed behind a boom 4 and a gantry 41 is disposed behind the mast 40. The gantry 41 has a pair of right and left gantry compressing (compression) members 42 and a pair of right and left gantry pulling (tension) members 43, the gantry compressing members 42 and the gantry pulling members 43 being connected together at their front end portions to form a gantry top. The gantry 41 is configured so as to operate in the same way as the gantry 30 shown in FIG. 5 with a difference being recognized in only size.

As shown in FIGS. 3A and 3B, a hoisting winch 7 is installed the gantry 41 according to this second embodiment. On this regard, a description will now be given in detail. The hoisting winch 7 has a drum 7*a* and a shaft 7*b* serving as a rotational center of the drum. Both ends of the shaft 7*b* are supported rotatably by brackets 14 provided respectively in the pair of right and left gantry compressing members 42.

As shown in FIG. 2, a guy line 44 is connected between the mast 40 and the boom 4. A mast-side spreader 45 is connected to the mast 40 and a gantry-side spreader 46 is connected to the gantry 41. A hoisting rope 47 extending from the hoisting winch 7 mounted to the gantry 41 is spread on both spreaders 45 and 46. When the mast 40 is raised or lowered by the winch 7, the boom 4 connected to the mast 40 through the guy line 44 is raised or lowered.

Thus, in the boom hoisting device of this second embodiment, since the hoisting winch 7 is installed to the gantry 41, the hoisting winch 7 can be removed together with removal of the mast-side spreader 45 from the mast 40 and removal of the gantry 41 from the upper rotating body 2. In this way the gantry 41 can be removed easily from the body frame without the need of pulling out the hoisting rope 47 from both spreaders 45 and 46. In this gantry removing work, as noted earlier, it is preferable that the mast-side spreader 45 is drawn close to the gantry-side spreader 46 by the hoisting winch 7 to make the mast-side spreader 45 difficult to shake during transport. The mast 40 may be left removed or mounted in accordance with transport weight.

AS to the form of the body frame when removing the gantry 41 in this second embodiment, there are included an integrally combined state of both lower travel body 1 and upper rotating body 2 and a separated state thereof.

Although in the above second embodiment the raising/lowering winch 7 is installed on the gantry compressing member 42 side, the winch 7 may be installed on the gantry pulling member 43 side to the contrary.

Moreover, although in the above second embodiment the hoisting winch 7 is installed not on the mast 40 side but on the gantry 41 side, no limitation is made thereto. It goes without saying that the hoisting winch 7 may be installed on the mast 40 side and that the hoisting rope 47 from the hoisting winch 7 may be conducted to the gantry-side spreader 46.

Further, although in the above first and second embodiments a description has been given about a constructional example wherein the boom hoisting device has a mast or both mast and gantry, no limitation is made thereto, but the present invention is also applicable to a boom hoisting device having a gantry with a mast omitted.

Figure 5:
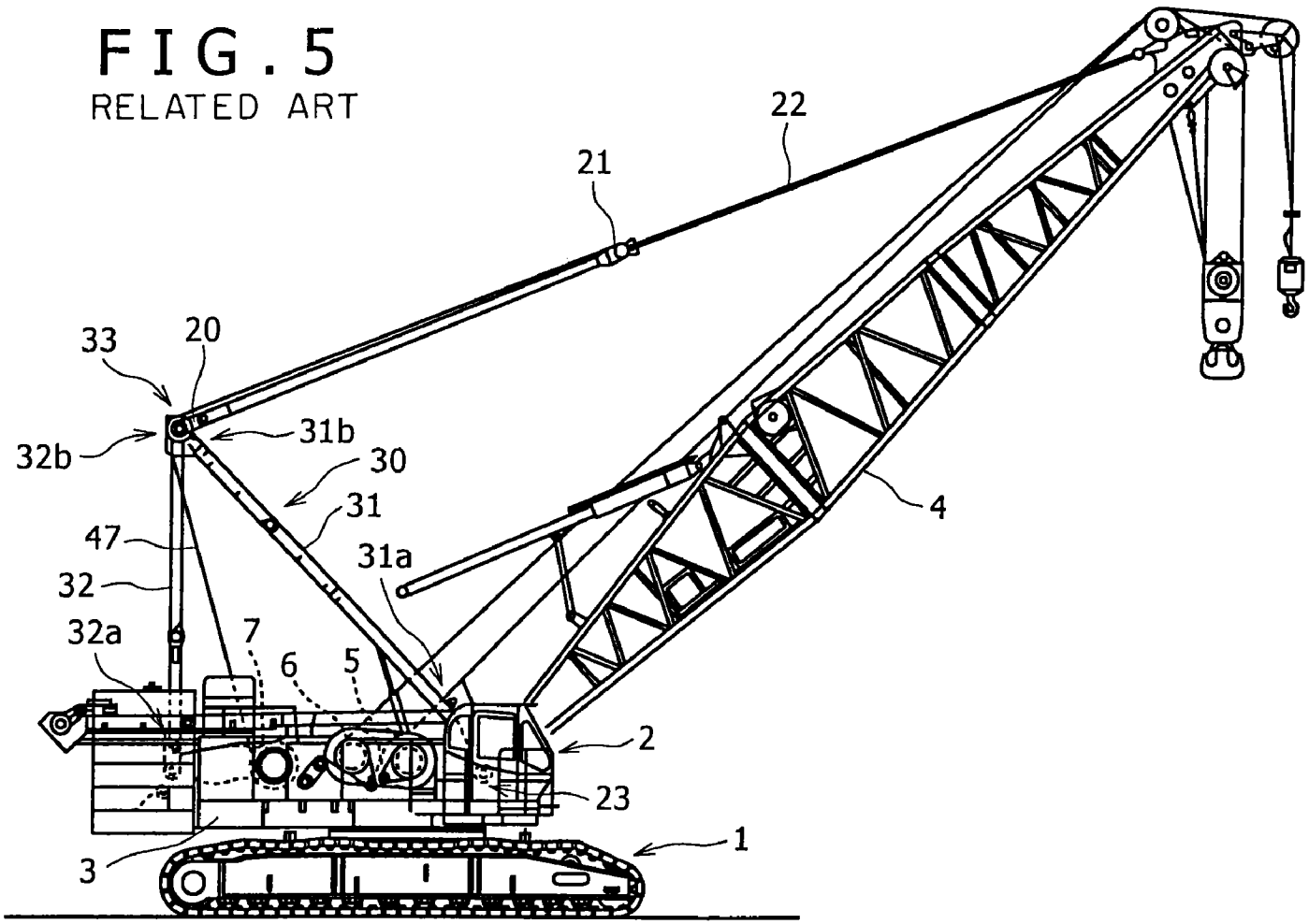
FIG. 5 RELATED ART
FIG. 5 is a right side view showing a crane having a gantry as a boom hoisting device according to the related art.

In this case, there may be adopted a configuration wherein the gantry is installed on the upper rotating body removably and a hoisting winch is installed to the gantry. More specifically, there may be adopted a configuration wherein the hoisting winch 7 shown in FIG. 5 is installed to the gantry compressing member 31 or the gantry pulling member 32 of the gantry 30.

Although the invention has been described with reference to the preferred embodiments in the attached figures, it is noted that equivalents may be employed and substitutions made herein without departing from the scope of the invention as recited in the claims.

We claim:

1. A boom hoisting device of a crane, said boom hoisting device being mounted on a body frame of the crane having a boom capable of rising and lowering and causing the boom to rise and lower, said boom hoisting device comprising:

a mast, said mast having a base end portion connected to said body frame removably and pivotably about an approximately horizontal axis and further having a front end portion connected to a front end portion of said boom through a guy line;

a mast-side spreader provided at the front end portion of said mast;

a frame-side spreader removably mountable to said body frame, wherein said frame-side spreader is dismounted from said body frame with a hoisting rope being stretched between and spread on both said frame-side spreader and said mast-side spreader; and a hoisting winch directly mounted to said mast and adapted to unwind and wind said hoisting rope to raise and lower said mast and said boom, wherein the mast and the hoisting winch may together be removed from said body frame by disconnecting the frame-side spreader from the body frame and by disconnecting the base end portion of the mast from the body frame during transport.

* * * * *